US006116994A

United States Patent [19]

Ito et al.

[11] Patent Number: 6,116,994

[45] Date of Patent: Sep. 12, 2000

[54] POLISHING APPARATUS

[75] Inventors: Kenya Ito, Fujisawa; Hideo Aizawa, Ayase, both of Japan

[73] Assignee: Ebara Corporation, Tokyo, Japan

[21] Appl. No.: 09/058,163

[22] Filed: Apr. 10, 1998

[30] Foreign Application Priority Data

| | | | |
|---|---|---|---|
| Apr. 11, 1997 | [JP] | Japan | 9-110147 |
| Apr. 11, 1997 | [JP] | Japan | 9-110148 |
| Apr. 11, 1997 | [JP] | Japan | 9-110149 |
| Apr. 21, 1997 | [JP] | Japan | 9-117536 |

[51] Int. Cl.[7] ..... B24B 5/00

[52] U.S. Cl. ..... 451/288; 451/289; 451/290; 451/443

[58] Field of Search ..... 451/288, 289, 451/287, 285, 290, 292, 331–335, 339, 443, 444

[56] References Cited

U.S. PATENT DOCUMENTS

| | | | |
|---|---|---|---|
| 3,978,622 | 9/1976 | Mazur et al. . | |
| 5,232,875 | 8/1993 | Tuttle et al. . | |
| 5,498,196 | 3/1996 | Karlsrud et al. | 451/11 |
| 5,618,227 | 4/1997 | Tsutumi et al. | 451/288 |
| 5,655,954 | 8/1997 | Oishi et al. | 451/289 |
| 5,660,581 | 8/1997 | Shin et al. | 451/289 |
| 5,679,055 | 10/1997 | Greene et al. | 451/289 |
| 5,738,574 | 4/1998 | Tolles et al. | 451/289 |
| 5,908,347 | 6/1999 | Nakajima et al. | 451/289 |
| 5,989,107 | 11/1999 | Shimizu et al. . | |

OTHER PUBLICATIONS

Pending U.S. application No. 08/857,252, filed May 16, 1997, by Noburu Shimizu et al., entitle "Method for Polishing Workpieces and Apparatus Therefor", located in Group Art Unit 3723.

*Primary Examiner*—M. Rachuba
*Attorney, Agent, or Firm*—Wenderoth, Lind & Ponack, L.L.P.

[57] ABSTRACT

A compact polishing apparatus has been developed which can be installed in a relatively small space, and is highly rigid without increasing the weight of the apparatus. The polishing apparatus comprises a polishing table, a top ring head for rotatably holding a substrate, a substrate transfer device for transferring the substrate to and from a substrate storage section, a substrate delivery device for delivery of the substrate between the top ring head and the substrate transfer device at a delivery position outside of the polishing table. A guide rail device is laid between the polishing table and the substrate delivery device, and a carriage device movable along the guide rail device is provided for carrying the top ring device thereon.

7 Claims, 10 Drawing Sheets

POLISHING APPARATUS

BACKGROUND OF THE INVENTION

1. Field of the Invention

The present invention relates in general to substrate polishing apparatuses, and relates in particular to a polishing apparatus suitable for use in polishing a substrate which requires a high degree of cleanliness, such as a semiconductor wafer, a glass substrate and a liquid crystal panel.

2. Description of the Related Art

In recent years, as semiconductor devices become highly integrated, circuit lines have become microsized, and interline spacing has also been greatly reduced. To produce finely resolved lines by photolithographic techniques, a higher degree of flatness is required in the substrate because of the shallow depth of focus of the optical system inherent in stepper image reproduction system. Such flatness requirements are the same for preparing glass substrates for masking or for liquid crystal panels. A method of obtaining a flat surface on a substrate such as semiconductor material is chemical mechanical polishing (CMP) in which a substrate held on a substrate holding device is polished by pressing the substrate against a polishing cloth mounted on a rotating turntable and supplying a polishing solution containing abrasive particles on the polishing cloth.

FIG. 11 is a schematic overall plan view of a conventional polishing facility. The dual-line facility is comprised of substrate storage sections 200*a*, 200*b* for storing substrates to be polished; at least two polishing units comprised of a first polishing unit 206*a*, and a second polishing unit 206*b*, each having its own turntable 202 and own top ring 204; cleaning devices 208*a*~208*d* for washing and drying the polished substrates which have been processed in the polishing units; a transport device 210 for transporting the cleaned substrates between processing stations; and inverting devices 212*a*, 212*b* for inverting the substrate.

In each line of the polishing facility, a substrate transported from the storage sections 200*a*, 200*b* by the transport device 210 is inverted by the inverting devices 212*a*, 212*b*, and the inverted substrate is transported by the transport device 210 to the polishing units 206*a*, 206*b* for polishing the bottom surface of the substrate. The polished substrate is transported back to the inverting devices 212*a*, 212*b* to again invert the substrate to orient the polished surface upwards, and the inverted substrates are transported back to the cleaning devices 208*a*~208*d* for washing and drying.

As shown in FIG. 12, each polishing unit 206*a* or 206*b* is comprised of, for example: a drive device 233 for driving a turntable 202 having a polishing cloth (polishing tool) 230 adhered thereon; a top ring device 204 having a top ring head 234 for vacuum chucking of a substrate for pressing the substrate against the polishing cloth 230 with a specific pressure; a dressing device 240 having a dressing head 238 for conditioning the polishing cloth 230; and a polishing solution supply device 242 for supplying a polishing solution containing water and abrasive grains to turntable 202 and top ring head 234.

Top ring head 234 is connected to the bottom end of a main shaft 246 supported through an end of a swing arm 244 in such a way as to permit vertical and rotational movements of the main shaft 246. Polishing is performed by the top ring head 234 by first receiving a substrate from a substrate delivery device (not shown) disposed on a lateral-side of the turntable 202, and then holding and rotating the substrate by means of the rotating main shaft 246. In the meantime, the dressing head 238 is also similarly supported through the end of the swing arm 244 at the bottom end of the main shaft 246 so as to be rotatable and movable vertically to perform dressing of the polishing cloth 230.

As can be seen in FIG. 12, the polishing units 206*a*, 206*b* perform polishing by the action of the independently-rotatable turntable 202. Therefore, at the center of the turntable 202, there is no displacement of the cloth and no polishing can be performed. So, polishing is performed off-center on the turntable 202. In such an arrangement, the diameter of the turntable 202 becomes more than twice the substrate diameter.

The drive mechanism for the main shafts 246 for rotating the top ring device 204 and the dressing device 240 is comprised of a motor 250 at the proximal end of the swing arm 244, while at its free end, it is comprised of a drive pulley 254 rotated by the gear inside a gear box 252; a follower pulley 256 rotating with the main shaft 246; and a timing belt 258 to transmit the drive force between the drive pulley 254 and the follower pulley 256.

An encoder 260 is provided at the top end of the motor shaft of the motor 250, thereby receiving feedback signals to optimally control the rotation of the top ring head 234 or the dressing head 238 at a predetermined cycle by way of the main shaft 246.

One of the operational problems in such a conventional polishing apparatus is that the top ring head is supported by the swing arm disposed on the lateral-side of the turntable, and substrate handling is performed by swinging the swing arm. Therefore, it is necessary that no mechanical interference be encountered within the swinging radius of the swing arm. Furthermore, because the facility also includes a dressing device, mechanical interference must be avoided for both devices, and the result is that there is a need to allocate a fairly large installation space.

Also, the top ring head is supported at one end of the swing arm in a cantilever manner, and because of the weight of the additional devices for generating rotating and pressing actions, the swing arm has to be constructed with a high degree of stiffness. However, if the strength of the swing arm is achieved by increasing its stiffness, the swing arm itself becomes massive, increasing weight so that this approach has its limit. The same problem are encountered for the dressing head.

A second operational problems of the conventional polishing apparatus is that because the diameter of the turntable must be more than twice the diameter of the substrate, a large floor space is necessary, and the overall polishing apparatus also becomes very large, resulting in a high attendant capital cost. This problem would become worse with the modern tendency to increase the diameter of the substrate.

Therefore, there have been proposals for replacing or supplementing such a polishing apparatus with a polishing unit of a smaller diameter to move in a circular translation pattern. In this case, the total polishing surface on the polishing cloth is subjected to an identical movement to be utilized effectively in removing the substrate material so that the size of the polishing tool needs to be about the same as the substrate size. However, the action of the driver to produce such a circular translation motion requires eccentric positioning of the drive shaft with respect to the center of the polishing table, and in such an arrangement, if the drive shaft is not properly balanced, the entire apparatus becomes vulnerable to vibration. Additionally, because the center of gravity of the drive shaft and that of the polishing table are not coincident, table rotation produces dynamic instability and results in vibrations. The overall effect is that the polishing operation becomes unstable and environmental problems will be generated.

A third problem in the conventional polishing apparatus is that, because the motor rotation is transmitted to the main drive shafts (for top ring head 234, dressing head 238) through the timing belts, feedback response is slow in providing a real time control of the shafts' rotations. For example, response delays can occur in detecting the resistive forces being experienced by the top ring head 234 and dressing head 238 during the polishing or dressing operation, or conversely, delays can occur in transmitting the response change in drive force to the main shaft. Further, when vibrations are generated in any of the swing arms, gear boxes, and transmission systems, including the timing belts, such vibrations are transmitted to the polishing tools (top ring head and dressing head), and consequently, fluctuations in rotation of the polishing tools introduce inconsistencies in performance of the polishing tool, thereby interfering with the process of creating uniform flatness.

A fourth problem in the conventional polishing apparatus is that, since the downward-facing surface of the substrate is polished in the polishing process, which is followed by a cleaning process using a cleaning device arranged to clean the polished surface of the substrate, it is necessary to interpose a substrate-inverting step between the two processes. This arrangement not only contributes to increasing the production cost, but the inverting process is time-consuming as well as inefficient.

SUMMARY OF THE INVENTION

It is a first object of the present invention to provide a compact polishing apparatus which can be installed in a relatively small space and which is highly rigid without increasing the weight of the apparatus.

The first object has been achieved in a polishing apparatus comprising a polishing table having a polishing tool thereon; a top ring head for rotatably holding a substrate and pressing a polishing surface of the substrate against the polishing tool with a specific pressure; a substrate transfer device for transferring the substrate to and from a substrate storage section; a substrate delivery device for delivery of the substrate between the top ring head and the substrate transfer device at a delivery position outside of the polishing table; a guide rail device laid between the polishing table and the substrate delivery device; and a carriage device movable along the guide rail device for carrying the top ring device thereon.

Accordingly, in the polishing apparatus presented above, because the top ring device is carried by a carriage device which moves along the guide rail device, resulting in that the top ring device can be supported by a stable support structure, and furthermore, by locating the carriage device in a small region between the polishing device and the substrate delivery device, the polishing apparatus can be arranged compactly to reduce the installation space.

In the apparatus, a dressing device for dressing the polishing surface of the polishing tool may be mounted on the carriage device in such a way that when the top ring device is positioned in a working relation to the substrate delivery device, the dressing device is positioned in a working relation to the polishing table. Accordingly, it is possible to perform dressing of the polishing tool concurrently with handling of a substrate between the top ring head and the substrate delivery device while preventing mechanical interference between the top ring and the dressing device.

In the apparatus, the carriage device may be operated with a ball-screw arrangement. Accordingly, the top ring device (applicable also to the dressing device) can be positioned with precision.

In the apparatus, the polishing table may be designed to produce a circulative translation movement with respect to the substrate. Accordingly, the size of the top ring device can be made substantially the same as the substrate size, thereby providing an overall compact polishing apparatus.

The second object of the invention is to provide a compact polishing apparatus that requires a relatively small installation space and prevents vibration in the drive shaft so that high quality polishing can be carried out. Such an object has been achieved in a polishing apparatus comprising a polishing table having a polishing tool thereon, a drive shaft for driving the polishing table in a circular translation pattern through an eccentric coupling, and a balancer piece disposed in a specific location along an axial direction of the drive shaft. Attachment locations of the balancer piece are adjustable in a circumferential direction.

Accordingly, because of the circular translating movement of the polishing table, the size of the polishing table can be made basically the same as the size of the object to be polished. If the load on the drive shaft is unbalanced, it can be easily corrected on-site by individual adjustments of the location of a balancer piece so that generation of vibrations and uneven polishing can be prevented. A plurality of balancer pieces may be provided in the specific location.

The drive shaft may be provided with a circumferential groove for engaging with the balancer piece. Accordingly, not only adjusting of the attachment position of the balancer piece along the groove is facilitated, but the balancer piece can also be prevented from falling off.

A third object of the invention is to provide a precise real time control of the main shaft rotation by eliminating delays in responding to signals from the encoder while preserving the compact arrangement of the apparatus. The third object has been achieved in a polishing apparatus comprising a holding device attached to a main shaft for holding a substrate while pressing it against a polishing table surface; a drive motor for rotating the holding device by way of the main shaft in a plane parallel to the polishing table surface; and a pressing device for pushing the holding device toward the polishing table surface, the main shaft being coupled directly to a rotor of the drive motor.

Accordingly, because the rotor of the drive motor is directly joined with the main shaft of the holding device, there is no need for an intermediate coupling device, so that time delay in controlling the rotation of the holding device can be eliminated, thereby improving the real time precision control of the main shaft speed while still maintaining the compactness of the apparatus to save installation space.

The main shaft may pass vertically through the drive motor to be coupled to the rotor in a sliding manner along an axial direction by way of a spline groove arrangement provided on the outer surface of the main shaft and the inner surface of the rotor. Accordingly, rotation and vertical movement of the main shaft can be performed without interference from the other, thereby enabling smooth control of the pressing pressure against the polishing table.

The spline groove may be provided with bearing balls, thereby enabling sliding movement smooth along the main shaft while eliminating any slack in the transmission of rotational force.

The drive motor may comprise an AC servomotor. Accordingly, control of the drive motor is facilitated, thus enabling the performance of polishing of substrates for semiconductor devices that produces excellent flatness and dressing of the polishing tool, for example.

A fourth object of the invention is to provide a compact polishing apparatus which can perform a series of steps in polishing and cleaning processes in a small installation space while eliminating the necessity for inverting the polishing object. The fourth object has been achieved in a polishing apparatus comprising a tool attachment plate having a tool attachment surface on a bottom end; a support section for supporting the tool attachment plate to enable a circular translation motion of the tool attachment plate in a substantially horizontal plane; a drive section for driving the tool attachment plate in a circular translation pattern in a substantially horizontal plane; and a substrate holding device for holding a substrate against the tool attachment surface of the tool attachment plate.

Accordingly, the tool attachment plate is able to perform a circular translation movement by the rotation of the drive shaft, i.e., a revolution movement about the center of the drive shaft, thereby reducing the size of the tool attachment plate. Furthermore, because polishing and cleaning steps can be performed on the upper side of the substrate, this apparatus can provide an easy and in-situ observation of the polished surface, and it can be used in combination with an upper-surface-cleaning device to carry out a series of processing steps, while also providing a polishing apparatus which eliminates the need for inverting the substrate.

The drive section may include a rotation drive shaft; an eccentric arrangement for eccentrically attaching the tool attachment plate to the rotation drive shaft; and a balancing device provided on the rotation drive shaft. Accordingly, dynamic imbalance in the drive shaft created by eccentric attachment of the tool attachment plate to the drive shaft can be readily balanced to prevent the generation of vibration in the apparatus.

DESCRIPTION OF THE PREFERRED EMBODIMENTS

Figure 1:
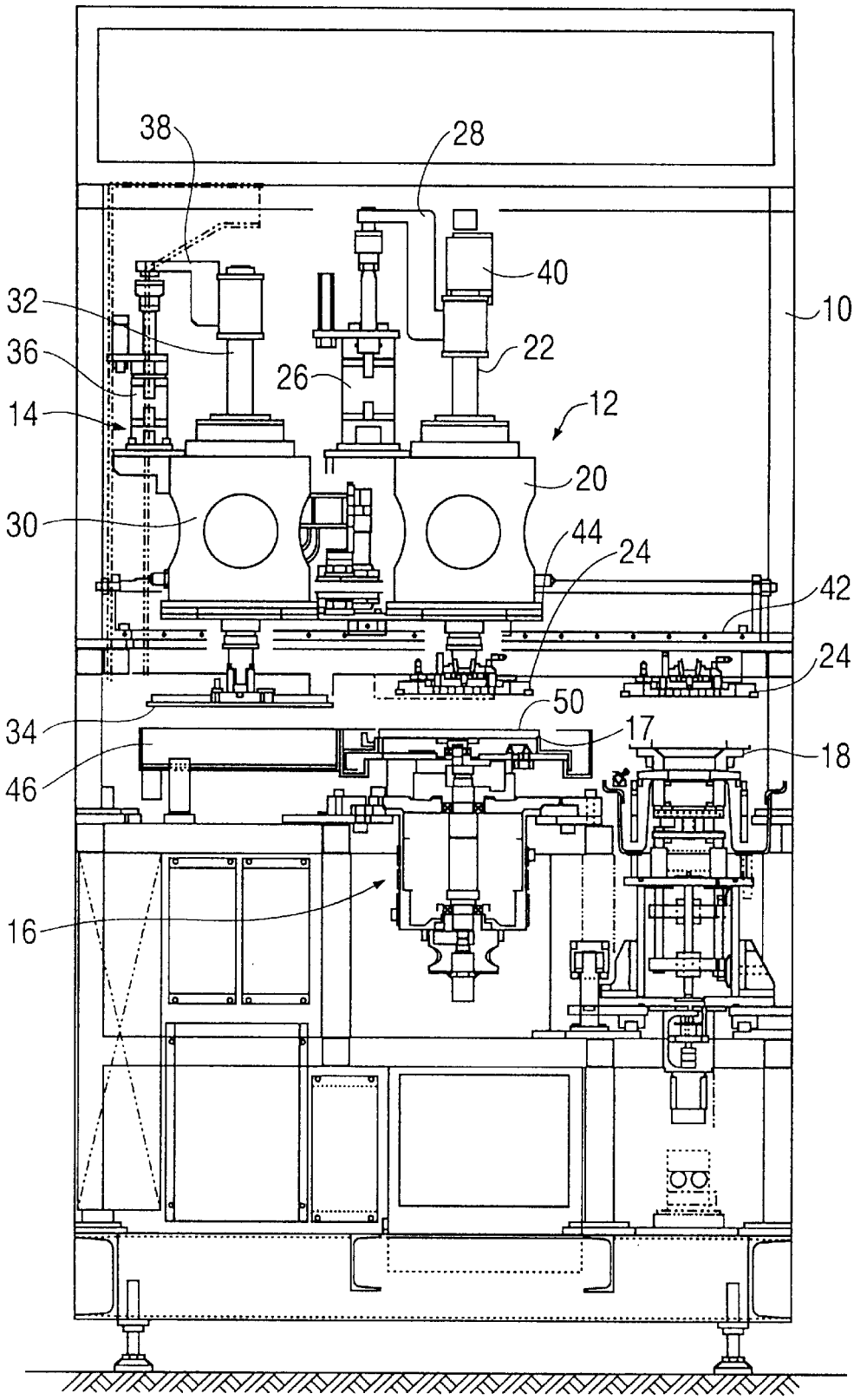
FIG. 1 is a front view of a polishing section of an embodiment of a polishing apparatus of the present invention in which a tool attachment plate is omitted.

In the following, preferred embodiments will be presented with reference to the drawings. FIGS. 1~9 show a polishing section of an embodiment of a polishing apparatus for a substrate such as a semiconductor wafer as an example of the polishing object. The polishing section is comprised by an overall rectangular frame 10 having a top section for housing a top ring device (substrate holding device) 12 and a dressing device 14 (polishing tool conditioning device), and a bottom section for housing a polishing unit 16 having a polishing table (tool attachment plate) 17 and a pusher member (substrate delivery device) 18 for handling the substrates. The polishing table (tool attachment plate) 17 is attached with a polishing disc (polishing tool) 50.

The top ring device 12 is comprised of a support shaft 22 passing through the interior of a cylindrical case 20; and a top ring head 24 for pressing a substrate against the polishing unit 16 while holding the substrate by vacuum chucking. A motor is housed in the case 20 and is used to rotate the support shaft 22 which is connected to a drive cylinder 26, disposed on a lateral-side of the case 20, through a coupling member 28 so as to vertically move the support shaft 22 according to the movement of the drive cylinder 26.

Likewise, the dressing device 14 is similarly comprised of a cylindrical case 30 with an internal support shaft 32, and a dressing head 34 comprising a dressing tool and attached to the bottom end of the support shaft 32 for conditioning the polishing disc 50. A motor is housed inside the case 30, and is used to rotate the support shaft 32 which is connected to a drive cylinder 36, disposed on a lateral-side of the case 30, through a coupling member 38 so as to vertically move the support shaft 32 according to the actuation of the drive cylinder 36.

Each of the support shafts 22, 32 is comprised of a spline shaft, and the spline shaft and the output shaft of the motor are slidably coupled in the spline groove. Therefore, the coupling of these shafts can transmit the rotational force of the motor as well as force for vertical movements of the cylinder 26, 36 to the support shafts 22, 32. An encoder 40 is provided on the top end of the support shaft 22 for the top ring device 12 for detection of shaft rotation. An encoder (not shown) is also provided on the top end of the support shaft 32 for the dressing device 14.

Figure 2:
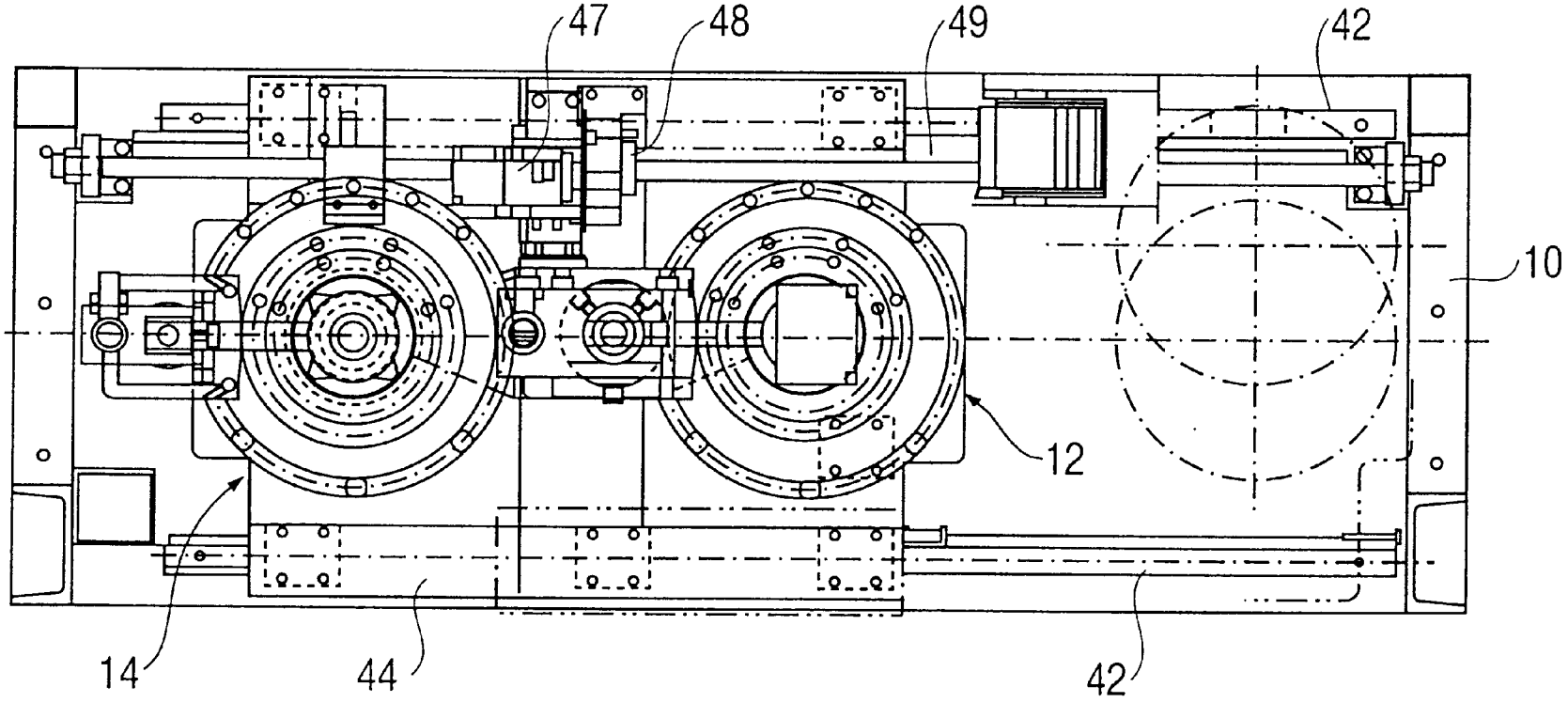
FIG. 2 is a plan view of the polishing section shown in FIG. 1.
Figure 3:
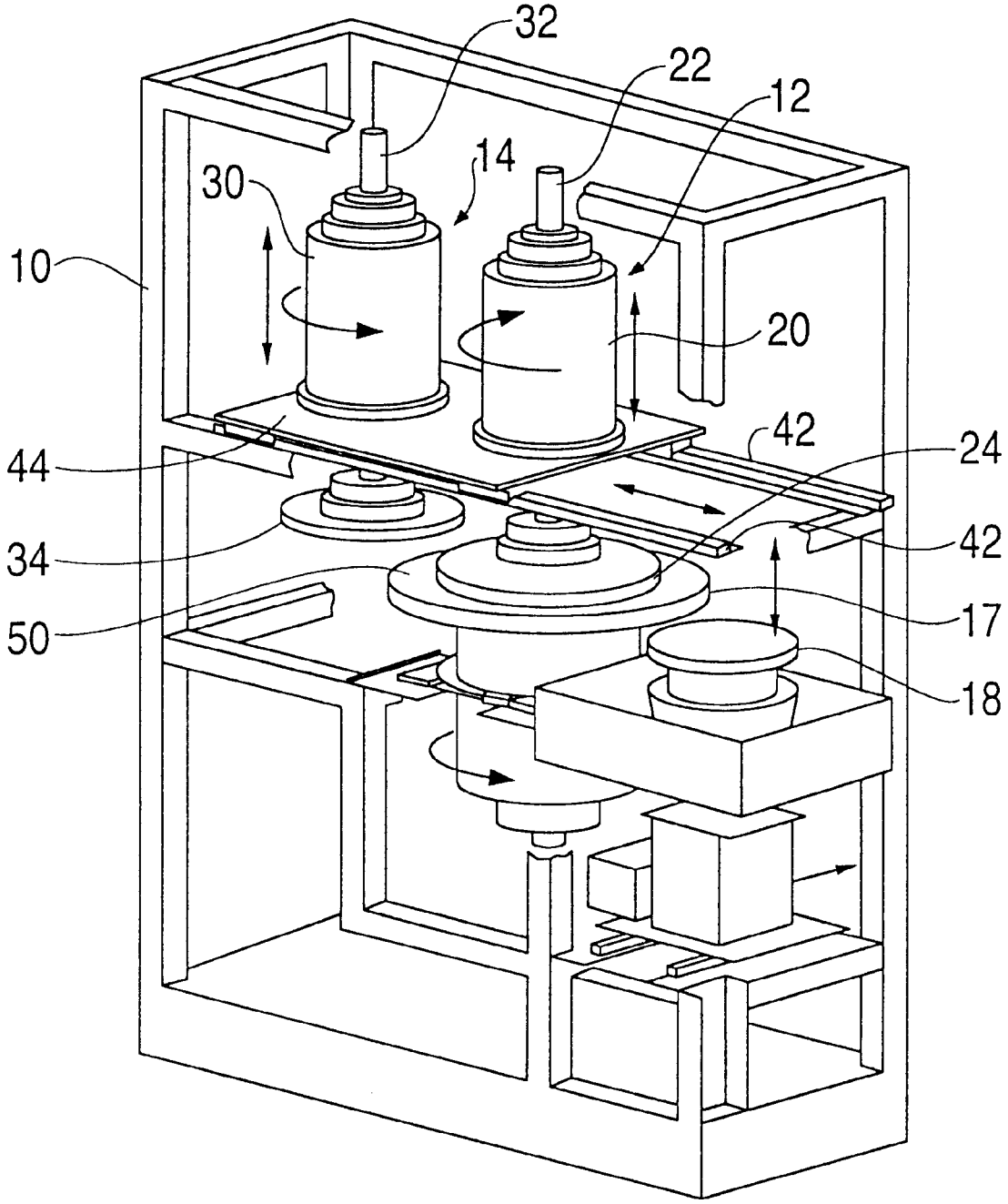
FIG. 3 is a perspective view of the polishing section shown in FIG. 1.

As shown in FIGS. 2 and 3, the top ring device 12 and dressing device 14 are mounted on a rectangular shaped flat carriage (carriage device) 44, movable in a horizontal direction, so as to protrude the top ring head 24 and the dressing head 34 downwards therefrom. Thus, as the carriage 44 is moved, the top ring head 24 of the top ring device 12 is able to transpose between the position right above the polishing table 17 and the position right above the pusher member 18. The top ring device 12 and dressing device 14 are arranged such that when the top ring head 24 is moved in a position above the pusher member 18, the dressing head 34 of the dressing device 14 is positioned correctly above the polishing table 17. When the top ring head 24 is positioned right above the polishing table 17, the dressing head 34 faces a rinse tank 46, filled with a rinsing solution, which is disposed directly below the dressing head 34.

The frame 10 has guide rails 42 for carrying the carriage 44 thereon. The carriage 44 is equipped with a servomotor 47 and a ball nut 48 which rotates with the servomotor 47. A ball screw 49 coupled to the ball nut 48 runs parallel with the guide rails 42. This arrangement permits precision positional control of the carriage 44, transposing along the guide rails 42 and being driven by the rotational motion of the ball nut 48 coupled to the servomotor 47.

By mounting the top ring device 12 and the dressing device 14 on the carriage 44 which moves along a pair of rails 42, both devices 12, 14 can be supported on a sturdy base, carriage 44, which is supported at both ends in a straddling manner on the rails 42, thereby increasing the total sturdiness of the system. Furthermore, the lateral and non-interfering arrangement of the top ring device 12 and the dressing device 14 on a horizontally transposing carriage 44 enables the construction of a compact apparatus which does not require a large installation space.

The polishing table 17 of the polishing unit 16 is of a type which has a polishing disc 50 mounted on top, but a polishing cloth is equally applicable. The pusher member 18 is for the purpose of handling the substrate between the top ring head 24 and a substrate handling robot, which is not shown in the drawing, and its position is adjustable vertically as well as forward and backward.

Detailed construction of the polishing unit 16 will be explained with reference to FIGS. 4 to 6. The unit 16 is comprised of a cylindrical case 54 housing a motor 52 therein; a base plate 56 covering the open end of the case 54; and a cylindrical base section 58 fixed to the base plate 56. The base section 58 supports the polishing table 17 by means of a plurality of support sections 60. The bottom surface of the polishing table 17 and the top surface of the base section 58 are coupled to each other by a crank shaft 66 whose ends, link shafts 66*a* and 66*b*, are inserted into a corresponding series of depressions 17*a* and 58*a* formed on the table 17 and the base 58, through their respective bearings 62, 64. The link shafts 66*a*, 66*b* are eccentric, by an eccentricity distance "e", with respect to the center of the crank shaft 66 so that the polishing table 17 can move in a circular translation motion of a radius "e".

Also, in the center section of the polishing table 17, a central hole 17*b* is formed to fittingly receive, through a bearing 70, a drive pin member 68*a* provided eccentrically on the drive shaft 68 driven by the motor 52. The eccentricity of the drive pin member 68*a*, i.e., the distance between the center $O_2$ of the drive pin member 68*a* and the center $O_1$ of the drive shaft 68, is the same as the eccentricity "e" of the link shafts 66*a*, 66*b*. The motor 52 is housed in a motor chamber 72 provided inside the case 54, and its drive shaft 68 is supported by upper and lower bearings 74, 76.

The polishing table 17 has a diameter which is slightly larger than a sum of the diameter of the polishing object (such as a semiconductor wafer) plus two times of the eccentricity value "e", and has a polishing disc (polishing tool) 50 fixed on its top surface. As shown in FIG. 4, a space 78 is provided between the polishing disc 50 and the polishing table 17 for supplying a polishing solution to the top surface of the polishing disc 50. The space 78 communicates with a polishing solution supply hole (not shown) provided on a lateral-side and with a plurality of polishing solution outlet holes 50*a* provided through the polishing disc 50.

Surrounding the polishing table 17 is a solution recovery tank 80 with a peripheral guide plate 82 around the periphery of the polishing table 17 for guiding the polishing solution into the solution recovery tank 80.

Figure 4:
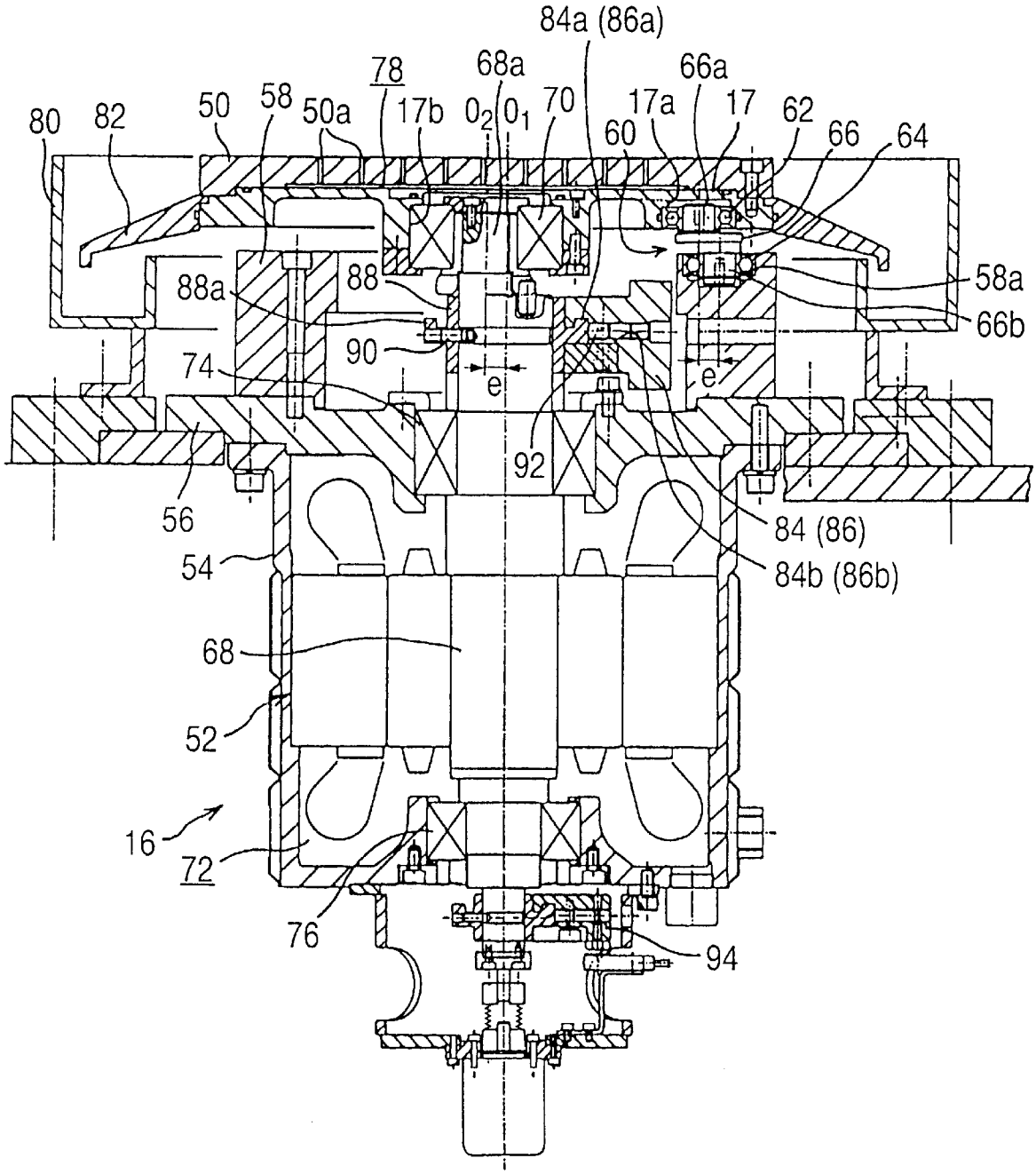
FIG. 4 is a cross sectional front view of a polishing unit shown in FIG. 1.
Figure 5:
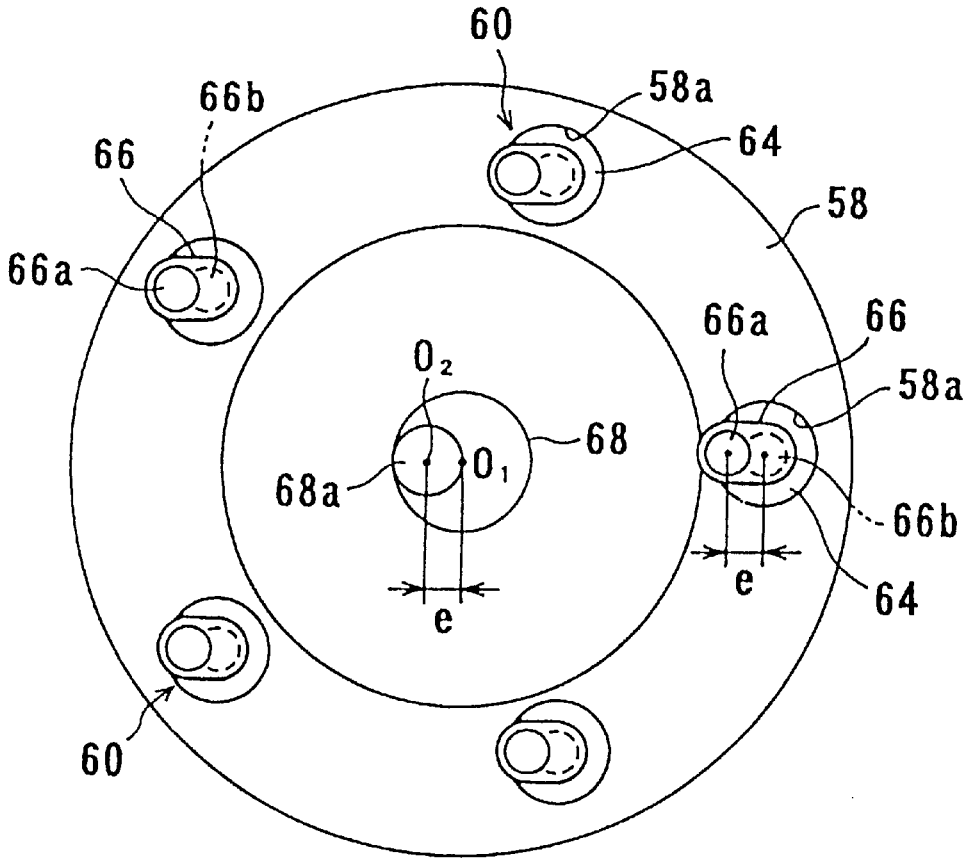
FIG. 5 is a partial plan view of the polishing unit shown in FIG. 4 where a tool attachment plate is removed.

With reference to FIGS. 4 and 5, the drive shaft 68 has upper and lower balancer members to balance during the eccentric rotation motion of the polishing table 17 to prevent vibrations and mechanical wear. The upper balancer member is comprised of two fan-shaped balancer pieces 84, 86 so that the total moment of inertia of the pieces 84, 86 equals the total moment of inertia constituted by the weight of the polishing table 17 and the polishing disc 50. The balancer pieces 84, 86 are attached to the drive shaft 68 so as to counter balance the eccentricity of the axis $O_2$ of the drive pin member 68*a* with respect to the axis $O_1$ of the drive shaft 68.

Figure 6:
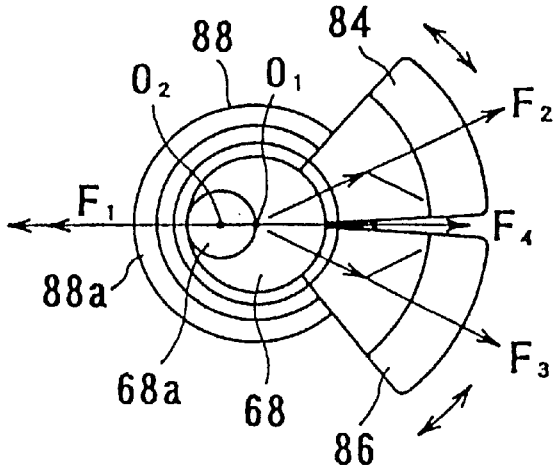
FIG. 6 is a schematic drawing explaining the action of the balancer on the drive shaft in the polishing unit shown in FIG. 4.

With reference to FIGS. 4 and 6, the attachment structure is as follows. A ring-shaped head attachment jig 88 having a curved section 88*a*, with a hook shaped cross section, surrounds the drive shaft 68 by means of a locking pin 90. In the meantime, grooves 84*a*, 86*a*, having a cross sectional shape similar to the cross sectional shape of the curved section 88*a* and extending in the circumferential direction, are provided on the inside periphery section of each balancer piece 84, 86, and also, screw holes 84*b*, 86*b* are provided to extend from the outer periphery of the balancer pieces 84, 86 into the grooves 84*a*, 86*a*. The balancer pieces 84, 86 are attached to the drive shaft 68 by coupling the curved section 88*a* of the head attachment jig 88 on the grooves 84*a*, 86*a* and inserting a locking pin 92 into the screw holes 84*b*, 86*b*, thereby reliably preventing the balancer pieces 84, 86 from falling off of the head attachment jig 88.

This construction of the balancer pieces 84, 86 enables relatively easily altering of their circumferential attaching position to the drive shaft 68, so that, as shown in FIG. 6, the resultant force $F_4$ developed by the balancer pieces 84, 86 can balance the load $F_1$ produced by the polishing table 17 during polishing. For example, the attachment position can be adjusted easily by loosening the locking pin 92 and suitably altering their relative attachment position while detecting the vibration with the ear or a transducer. By such an on-site adjustment of the balancer pieces 84, 86, the vibration of the polishing table 17 can be eliminated, thereby enabling stable polishing of the substrate.

An example of position adjustment is described below. The initial setting is made, as shown in FIG. 6, so that the pieces 84, 86 lie symmetrically on a line joining the centers $O_1$, $O_2$. Then, while detecting the vibration, the pieces are moved symmetrically first, and if this adjustment is insufficient to eliminate the vibration, then the pieces are moved asymmetrically. A trail and error approach may be successful in many actual cases because of the inherent differences in individual machines. The balancer member 94 disposed at the bottom end of the drive shaft 68 has a similar constriction. In all cases, vibration detection can be performed by providing sensors to the drive shaft or the polishing table to facilitate positioning of the balancer pieces 84, 86.

Figure 7:
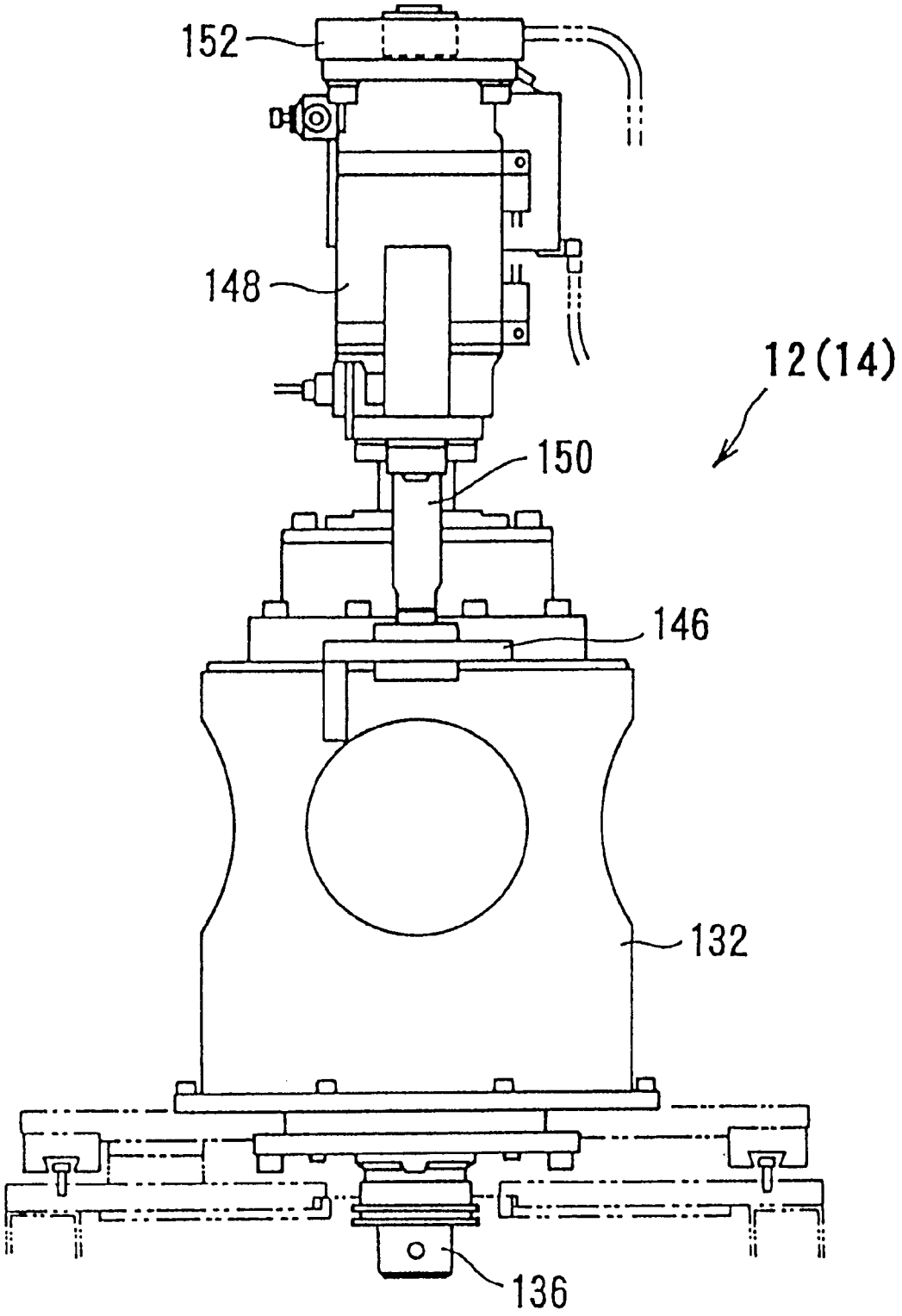
FIG. 7 is a front view of the polishing unit shown in FIG. 1.
Figure 8:
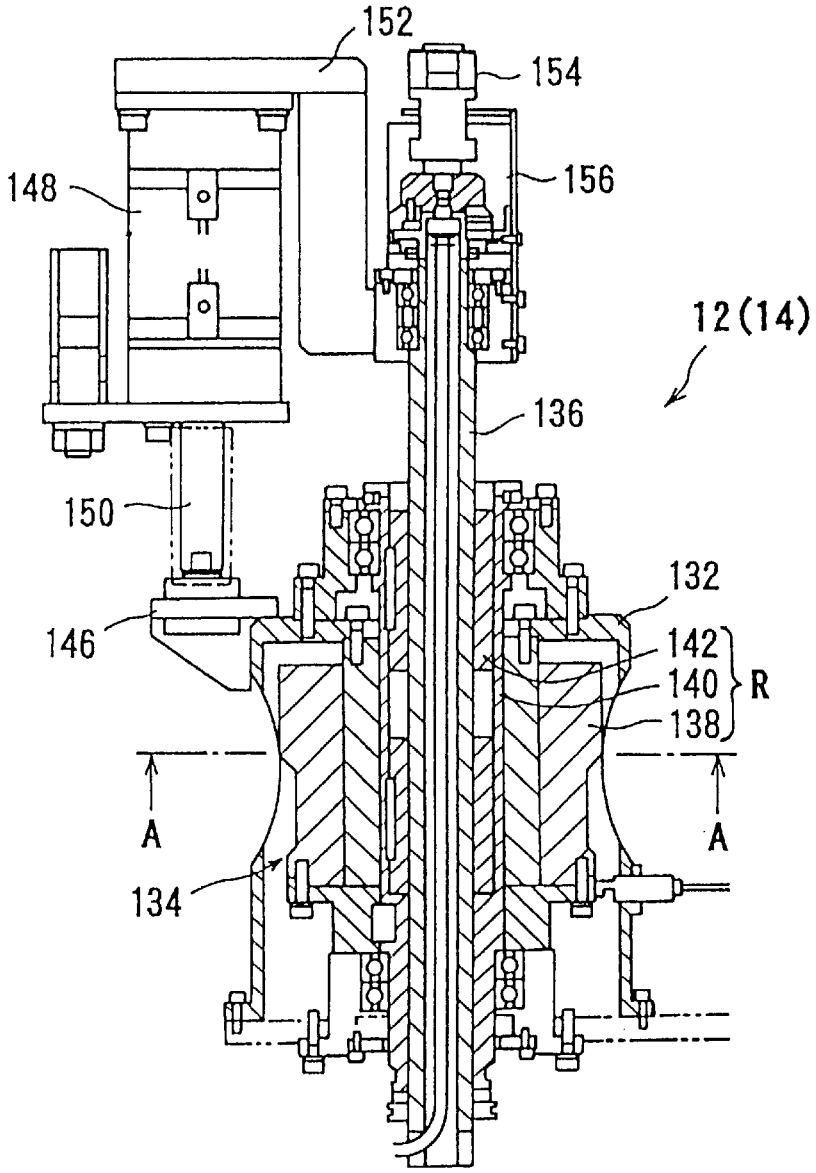
FIG. 8 is a cross sectional front view of the polishing unit shown in FIG. 7.
Figure 9:
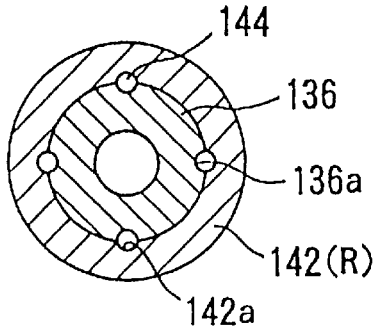
FIG. 9 is a view through a section A—A in FIG. 8.

FIGS. 7 to 9 show detailed construction of the top ring device 12 and the dressing device 14. A cylindrical case 132 is held on the beams of a frame 10 and houses a compact AC servomotor 134 of a high responsiveness, as well as a main shaft 136 comprising an attachment section at its bottom end for attaching a holding device such as the top ring head 24 and the dressing head 34.

With reference to FIGS. 7 and 8, the main shaft 136 has an internal throughhole for supplying a polishing solution or other liquids and is attached to the rotor shaft R of the servomotor 134 so as to rotate together as a unit while permitting some relative axial sliding motion. More specifically, spline grooves 136*a*, 142*a* are provided on the outer surface of the main shaft 136 and the inner surface of the rotor R (nut 142), and a plurality of balls 144 are held therein for maintaining a smooth sliding movement between the main shaft 136 and the rotor R. The rotor R is comprised of tube piece 140 coupled to the outside of the nut 142 and a rotor core (permanent magnet) 138 attached integrally to the tube piece 140. An iron core provided with a coil is located between the rotor core 138 and the tube piece 140, which is a stator of the motor 134.

The top section of the case 132 is attached, through a bracket 146, to a cylinder rod 150 extending downward from the bottom of an air cylinder (actuator) 148. A top cover 156 for shielding the top end of the main shaft 136 is fixed, through a connecting member 152, on the top section of the air cylinder 148. The top cover 156 is attached with an encoder 154 for monitoring the rotational behavior of the main shaft 136 and for sending a monitored signal to a control section (not shown) of the servomotor 134 and a polishing solution supply pipe (not shown). The control section provides a feed back control to maintain the rotational speed of the main shaft 136 at a predetermined value.

The operation of the polishing apparatus according to the first embodiment described above will be presented. The top ring head 24 moves to and receives a wafer from the pusher member 18, and is transported by the carriage 44 to above the polishing table 17 to be driven downward by the action of the air cylinder 148. While supplying a polishing solution to the polishing surface on the table 17 and operating the AC servomotor 134 to rotate the wafer, by means of the air cylinder 148, the wafer held on the top ring head 24 is pressed against, at a given pressure, the polishing surface of the polishing table 17 undergoing a circular translation movement to carry out a polishing step. The extending action of the cylinder rod 150 of the air cylinder 148 to protrude towards the stationary case 132 causes the main shaft 136 to rise, and the retracting action of the rod 150 causes the main shaft 136 to descend.

When the polishing step is completed, the carriage 44 is operated to move the top ring head 24 to a position above the pusher member 18 to transfer the polished wafer to the pusher member 18, and to receive an unpolished wafer. At this time, the dressing head 34 is positioned above the polishing table 17, and, while the wafer is being transferred from and to the top ring head 24, the dressing head 34 is lowered by operating the drive motor and the polishing disc 50 is dressed. While the wafer is being polished, the dressing head 34 is lowered into the rinsing tank 46 to rinse the dressing tool.

In the polishing process presented above, because the top ring head 24 is driven directly by the main shaft coupled to the drive AC servomotor 134 so that time-delay is virtually non-existent, compared with the conventional arrangement of pulleys and belts, its response characteristics are excellent. The driving force is transmitted through the balls 144 provided in the spline grooves 136*a*, 142*a*, and therefore, vertical movements can be smoothly transmitted together with rotational movements, thereby producing outstanding polishing behavior to yield polished wafers of superior flatness. Also, because complex transmission mechanisms are not required, the polishing apparatus can be made compact, thereby saving production cost as well as installation space.

It should be noted that, in the above embodiment, the movement pattern of the polishing table 17 was selected to be a circular translation motion, but it is obvious that other patterns such as rotational motion and linear reciprocating motion can also be adopted.

Figure 10:
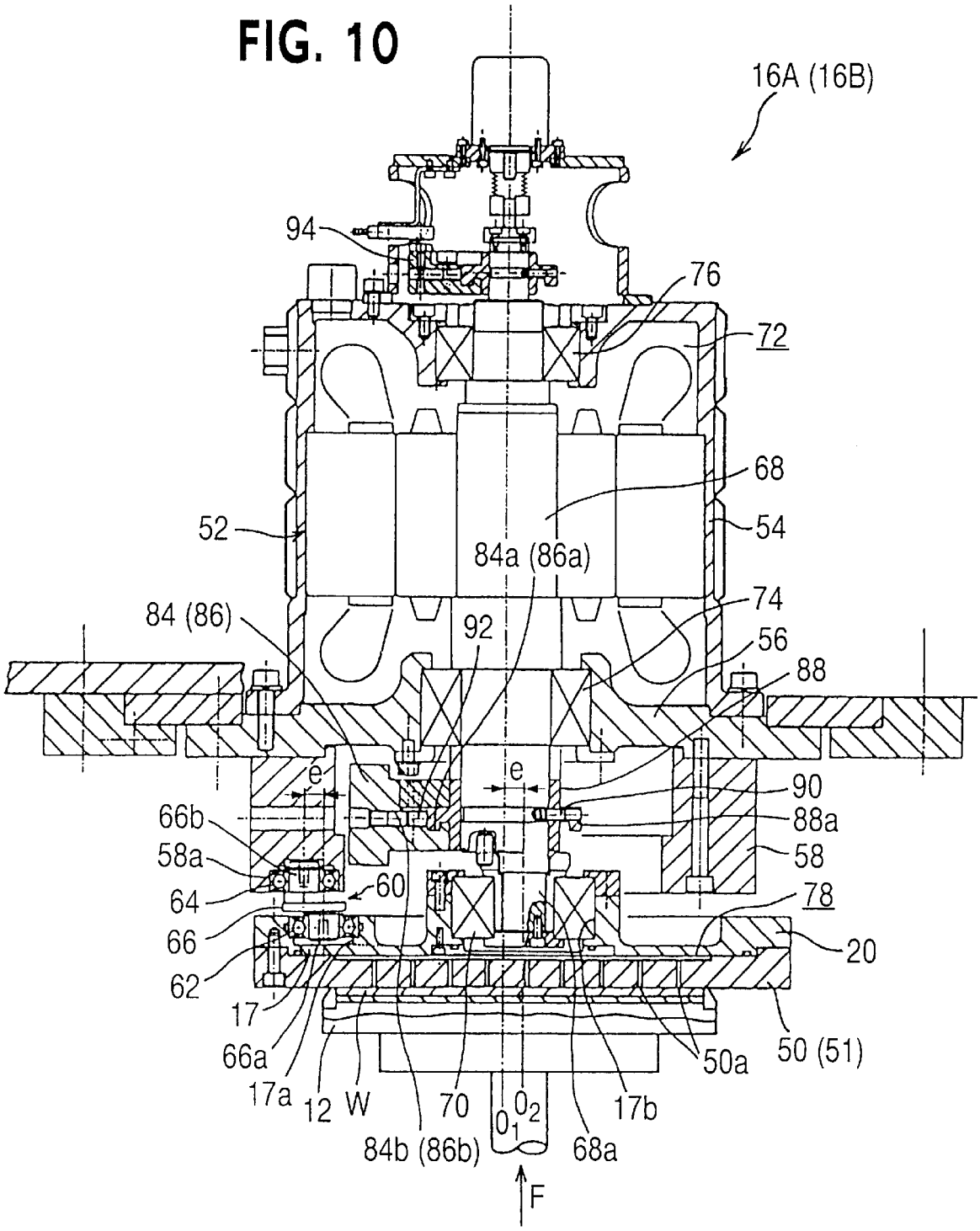
FIG. 10 is a cross sectional front view of another embodiment of the polishing apparatus.

FIG. 10 shows another embodiment of the polishing unit 16A, and its basic structure is a case of turning the previous embodiment upside-down so that the parts are rearranged upside to downside, resulting in that the polishing table having a polishing tool attachment surface on its bottom end is mounted on the top section of the frame by a supporting/driving assembly. Thus, the polishing tool attachment surface facing downward is provided with circular translation motion in a horizontal plane as before.

Figure 11:
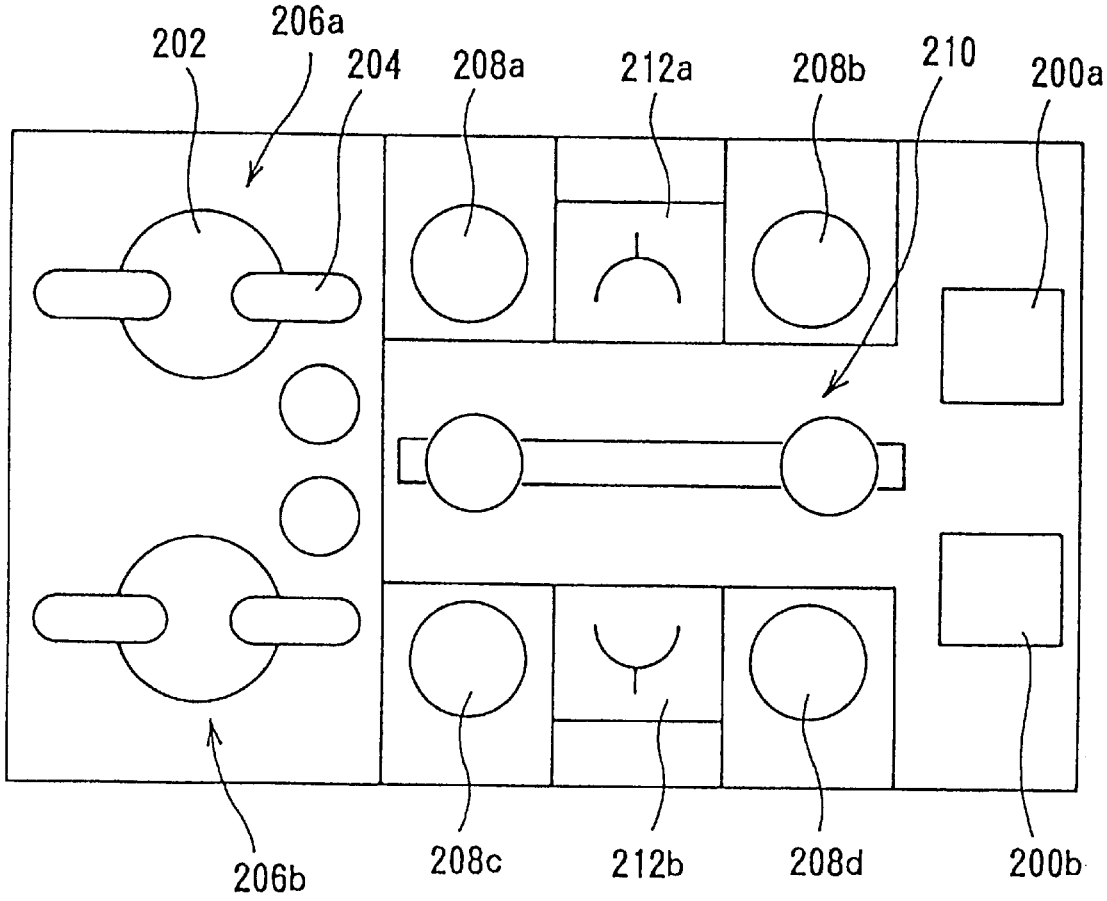
FIG. 11 is a schematic overall plan view of a conventional polishing facility.
Figure 12:
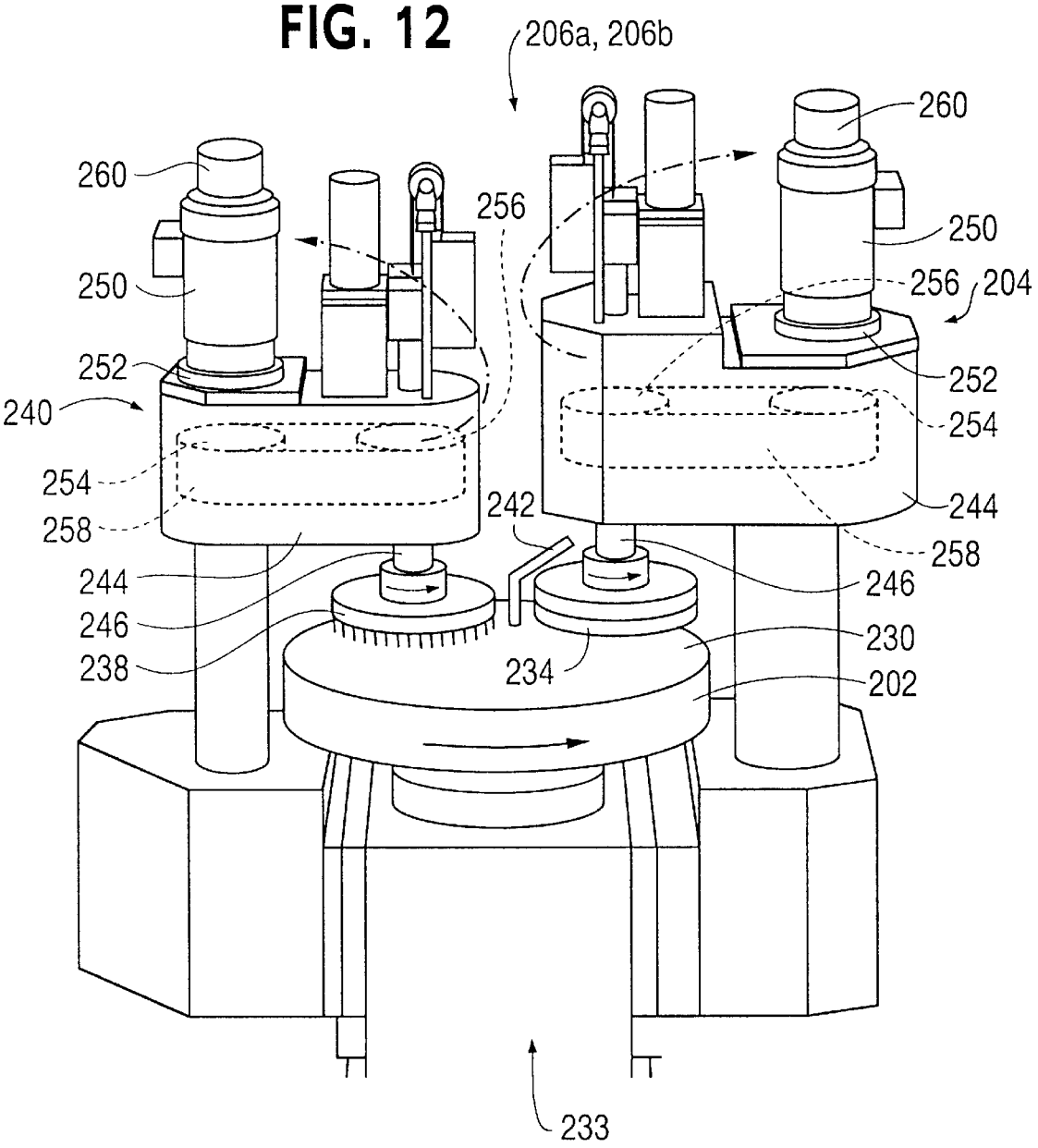
FIG. 12 is a perspective view of the conventional polishing apparatus.

By adopting such a configuration in polishing units 206*a*, 206*b* in a facility shown in FIG. 11 or in a polishing unit moving on the frame 10 shown in FIG. 1, it is possible to carry out a polishing process with the polished surface of the wafer facing upward. In this case, the polished wafer need not to be inverted to have the polished surface cleaned in the normal cleaning device. Therefore, it is possible to perform polishing and cleaning steps on the wafer without having to provide a wafer inversion device. In the previous apparatuses, the polishing solution needed to be supplied under some pressure, but in this configuration, gravity assistance lowers the required pressure.

It is permissible to use a polishing cloth instead of the polishing tool 50 on the polishing table 17 to perform surface finishing or cleaning step. The following example shows a case of adopting a polishing unit 16A and a polishing unit 16B in series, where the polishing unit 16A is the same as shown in FIG. 10, and the polishing unit 16B has a soft polishing cloth 51 instead of the polishing tool 50 shown in FIG. 10. Between the polishing units 16A and the cleaning unit 16B, a temporary holding stage may be provided so that a polished wafer from the top ring 12 of the polishing unit 16A can be transported there for temporary storage or for transfer to the top ring 12 of the cleaning unit 16B (or to be picked up by the top ring 12 of the polishing unit 16B). Other possibilities include an arrangement whereby the top ring 12 is omitted from the cleaning unit 16B, so that the top ring 12 of the polishing unit 16A continues to hold the wafer at the cleaning unit 16B for cleaning the wafer as well as at the polishing unit 16A.

The polishing process is designed to achieve a certain degree of material removal from the wafer so that the wafer and the polishing tool 50 are moved relative to each other at a high relative speed and pressing pressure as well as at a high rotational speed of the table, to increase the flatness of the wafer. In contrast, the cleaning process is designed to achieve cleanliness of the wafer by removing adhering particles as well as final improvement of the flatness and surface roughness. Therefore, the cleaning tool (cleaning cloth) 51 has a finer roughness and the relative movement speed between the cleaning tool 51 and the wafer, as well as the pressing pressure, are set less than those in the polishing process.

As the cleaning solution, pure water is normally used, and chemicals and slurry are used when needed. In other words, the contact interface is treated with an agent appropriate to each case. In the polishing process, abrasive particles are included, while in the cleaning process, abrasive particles are not used, or if required, only small amounts of very fine particles are used.

In this embodiment also, the polishing tool 50 and cleaning tool 51 are not rotated, and the advantage is that any location of the wafer is subjected to the same or similar relative speed between the wafer and the polishing tool 50, so that flatness can be achieved even at low polishing speeds, and a smooth surface can be readily produced, as well as that a small installation space for the apparatus is necessary. Furthermore, in the polishing unit 16A, because the motion of the polishing table 17 is a circular translation pattern, the polishing table 17 can be supported at several locations around its periphery so that even if a pressing force is applied to the wafer, the polishing table 17 is supported in a sturdy and stable manner and, compared with a centrally supported large-sized rotating type turntables, much superior flatness can be achieved.

Typical conditions for polishing and cleaning are compared in the following.

1. Polishing Process

| | |
|---|---|
| Polishing abrasive | selected to suit polishing object |
| Polishing cloth | as above |
| Pressing pressure | 200~500 g/cm$^2$ |
| Relative speed | 0.07~0.6 m/s |
| Duration | depends on amount of material to be removed |

2. Cleaning Process

| | |
|---|---|
| Cleaning solution | water, chemical solutions, slurry |
| Cleaning cloth | soft cloth (non woven fabric, laminated nap) |
| Pressing pressure | 0~200 g/cm$^2$ |
| Relative speed | 0.07~0.6 m/s |
| Duration | 10~120 s |

It should be noted that, in the above embodiment, the polishing table is subjected to a circular translation motion, but the substrate may be moved in a similar way. Also, in the above embodiment, an eccentric drive on the motor shaft is used to produce the motion of the table, but other methods may be used, for example, an x-y stage may be used to move the table as a vector sum of x- and y-directions. The polishing tool and the substrate may both be moved in circular translation patterns. Also, the table was supported with a crank type connection, but other support systems that can produce parallel translation while preventing self-rotation of the tools, such as magnetic bearings and non-lubricated sliding bearings can also be used.

In this embodiment, after polishing the wafer at a given pressure by using the polishing unit 16A by subjecting the tools to a circular translation motion, a cleaning process is then carried out by using the cleaning unit 16B by pressing the polishing/cleaning tool comprised of a wiping cloth or non woven cloth or other types of cloth against the polishing surface of a wafer to conduct scrubbing/cleaning of its surface. Therefore, both processes can be carried out within a small space, thereby minimizing the installation space for the apparatus.

In the embodiment, cleaning tools may include a wiping cloth and a polishing cloth for polishing purposes, in some cases. Commercially available materials for such cloths include non woven cloth made of polyester, Suba 800 or IC-1000 made by Rodel Co., Surfin xxx-5, Surfin 000 made by Fujimi Inc. Suba 800, Surfin xxx-5, Surfin 000 are polishing cloths made by bonding fibers with urethane resin, and IC-1000 is a polyurethane foam material. Foamed polyurethane is a porous material having numerous micro-voids on the surface, and it is considered that such voids are effective in capturing fine polishing particles.

Basically, polishing cloths are used for abrading the surface of semiconductor materials. Then surface structure is such that abraded particles can readily cling to the surface. By using such a cloth for cleaning purposes, particles which persistently adhere to the wafer surface can be easily detached. By using a polishing cloth basically intended for abrading as a cleaning tool for the present cleaning device, it has been confirmed that cleaning as well as smoothing functions are provided for obtaining a flatter wafer surface than in a conventional process.

Also, the wiping cloth is comprised of ultra-fine fibers of 1~2 $\mu$m diameters, and are commercially available by such names as Toray Miracle Series (trade name), and Kanebo Minimax (trade name). Such wiping cloths have a very high fiber density, on the order of 100,000~200,000 fibers per one square inch cross section, and are known to provide a high degree of micro-particle removal by significantly increasing the contact points on the surface of the wiping object. Because wiping cloths are very thin, they may be employed with an intermediate cushion material, such as sponge or rubber, on the attachment surface of the polishing table.

It is obvious that, although the above embodiments were illustrated using wafers, the present polishing apparatus is equally applicable to any other substrates that require a high degree of cleanliness, such as glass plates, and liquid crystal display panels. Modifications of the basic configuration are possible within the principle of the present invention as disclosed in the claims which follow.

What is claimed is:

1. A polishing apparatus, comprising:

a polishing table having a polishing tool thereon;

a top ring device for rotatably holding a substrate and pressing a polishing surface of the substrate against said polishing tool with a specific pressure;

a substrate transfer device for transferring said substrate to and from a substrate storage section;

a substrate delivery device for delivery of said substrate between said top ring device and said substrate transfer device at a delivery position outside of said polishing table;

a guide rail device extending between said polishing table and said substrate delivery device;

a carriage device mounted on and movable along said guide rail device and carrying said top ring device thereon; and a dressing device for dressing said polishing tool, said dressing device being mounted on said carriage device such that when said top ring device is positioned in working relation to said substrate delivery device, said dressing device is positioned in working relation to said polishing table.

2. The polishing apparatus of claim 1, wherein said guide rail device is linear.

3. The polishing apparatus of claim 1, wherein said guide rail device comprises two rails.

4. The polishing apparatus of claim 1, wherein said carriage device comprises a ball-screw device for movement of said carriage device.

5. The polishing apparatus of claim 1, wherein said polishing table is arranged such that operation of said polishing table, when the substrate is pressed against the polishing tool, causes a translation movement of said polishing table with respect to the substrate.

6. The polishing apparatus of claim 1, wherein said top ring device and said dressing device are positioned substantially parallel with said guide rail device.

7. The polishing apparatus of claim 1, wherein said substrate delivery device is positioned substantially parallel with said guide rail device.

* * * * *